United States Patent [19]

Lounsberry et al.

[11] Patent Number: 4,573,185

[45] Date of Patent: Feb. 25, 1986

[54] X-RAY TUBE WITH LOW OFF-FOCAL SPOT RADIATION

[75] Inventors: Brian D. Lounsberry, Hales Corners; Robert W. Meade, Brookfield, both of Wis.

[73] Assignee: General Electric Company, Milwaukee, Wis.

[21] Appl. No.: 625,277

[22] Filed: Jun. 27, 1984

[51] Int. Cl.[4] ..... H01J 35/10

[52] U.S. Cl. ..... 378/125; 378/144

[58] Field of Search ..... 378/144, 125, 138

[56] References Cited

U.S. PATENT DOCUMENTS 3,795,832 3/1974 Holland ..... 378/144

4,482,837 11/1984 Koizumi et al. ..... 378/144

FOREIGN PATENT DOCUMENTS 2203403 8/1973 Fed. Rep. of Germany ..... 378/144

*Primary Examiner*—Alfred E. Smith

*Assistant Examiner*—T. N. Grigsby

*Attorney, Agent, or Firm*—Donald E. Stoner; Alexander M. Gerasimow

[57] ABSTRACT

A tungsten focal track is placed on a graphite substrate in such a manner as to reduce off focal spot radiation while maintaining a fixed focal spot size. The radial width of the focal tract is made smaller than that of the electron beam from the cathode such that the electron beam overlap will allow for misalignments between the electron beam and the focal track without affecting the focal spot size or location.

15 Claims, 3 Drawing Figures

X-RAY TUBE WITH LOW OFF-FOCAL SPOT RADIATION

BACKGROUND OF THE INVENTION

This invention relates generally to X-ray tubes and, more particularly, to X-ray tube anodes having a focal track with a limited radial dimension for purposes of reducing off-focal spot radiation while maintaining a constant focal spot size.

X-ray tube targets are conventionally comprised of a relatively low-density substrate, such as molybdenum, with a high-density refractory metal focal track disposed thereon in the form of an annular ring. The associated cathode is then disposed in such a position as to emit electrons for bombardment of the focal track to produce X-rays. The radial width of the focal track is conventionally made sufficiently large so as to overlap on both sides of the electron beam. In this way, the relative alignment between the cathode and the anode is not critical in that, as long as the electron beam is located somewhere on the focal track, the resulting focal spot will be of a fixed size.

One of the problems associated with conventional X-ray targets is that of off-focal spot radiation, the primary cause of which is the straying of so-called "leakage" of electrons from the electron beam. This problem is substantially alleviated by the use of a hooded anode or some other collimation means to provide a fixed channel for the flow of electrons. There is, however, additional structural complications and cost involved with this solution.

Another cause of off-focal spot radiation is that of radiation caused by secondary electrons. As the electron beam bombards the focal track within a prescribed radial area, there are, in addition to the X-rays given off, the generation of secondary electrons which tend to dispurse strike other areas of the focal track, outside of the prescribed radial boundary. When this occurs, X-rays are generated at locations outside of the radial boundary to thereby constitute off-focal spot radiation and resultant reduction in resolution.

One approach for reducing the off-focal spot radiation would be to limit the radial width of the focal track to the same radial width as the projected electron beam. Such a structure is shown in U.S. Pat. No. 3,795,832.

A disadvantage of having equal radial widths for the focal track and the electron beam is that any relative misalignment will result in a focal spot of reduced size. Such a misalignment may result from a deviation of the electron beam, a condition which is substantially controllable by some type of focusing device, such as a cathode cup. Another cause of misalignment and one which is virtually always present, is that of Total Indicated Runout (TIR). This is the phenomenon wherein the radial distance between the center of rotation and the edge of the focal track varies as the anode rotates, thereby causing the focal track to effectively wobble with respect to the electron beam. Inasmuch as there will inherently be some TIR, an X-ray tube having equal radial widths for the electron beam and the focal track will result in a focal spot which varies cyclically in size.

A third and most prevalent cause of misalignment is that of radially mispositioning the filament such that the emitted electron beam is not properly aligned with the focal track.

It is therefore an object of the present invention to provide an X-ray tube with reduced off-focal spot radiation.

Another object of the present invention is the provision in an X-ray tube for a reduction of off-focal spot radiation without an associated variance in the focal spot size.

Yet another object of the present invention is the provision for an X-ray tube which is economical to manufacture and practical to use.

These objects and other features and advantages become more readily apparent upon reference to the following description when taken in conjunction with the appended drawings.

SUMMARY OF THE INVENTION

Briefly, in accordance with one aspect of the invention, an X-ray tube anode is constructed such that the radial width of its focal track is slightly less than the radial width of the electron beam emanating from the associated cathode. The difference in the radial widths is preferably chosen to be of a predetermined dimension which is equal to the anticipated amount of radial misalignment between the electron beam and the focal track, which in turn is dependent on the tolerance of the electron beam position and the Total Indicated Runout (TIR) of the anode. In this way, the focal spot size will remain constant while, at the same time, the heat inherently resulting from the bombardment of the anode substrate will be minimized.

By another aspect of the invention, the anode substrate is comprised of a graphite material which is relatively inefficient in the production of X-rays and which has a high sublimation temperature. The focal track is comprised of a high-density tungsten material which is disposed in a groove that has been formed in the substrate. The graphite substrate is formed of a material whose coefficient of thermal expansion matches that of the tungsten material such that the differential thermal expansion between the tungsten and the graphite at the interface is essentially zero during the heating of the tungsten (i.e., operation of the tube) to thereby enhance the reliability of the metalurgical bond between the graphite substrate and the focal track. A protective interim layer of an appropriate material, such as rhenium, may be applied to prevent the high-temperature diffusion of carbon into the tungsten focal track.

In the drawings hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
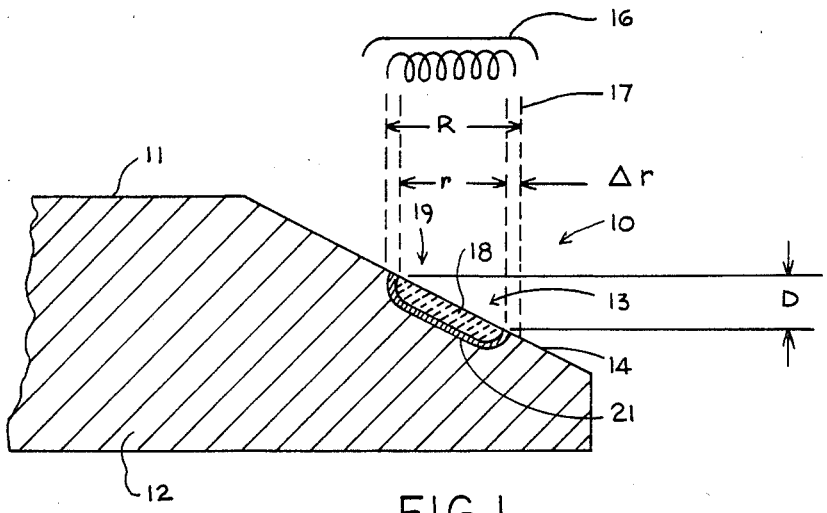
FIG. 1 is a schematic illustration of an X-ray tube anode constructed in accordance with the preferred embodiment of the invention.

Referring now to FIG. 1, the invention is shown at 10 as applied to a rotating anode 11 of an X-ray tube. The anode 11 is comprised of a disk-like substrate 12 and a focal track 13 formed as a ring in a beveled surface 14 of the substrate 12.

The substrate 12 is comprised of a relatively low-density material such as graphite, which acts to carry the focal track 13 and to perform as a heat sink for heat generated during the X-ray generation phases. The anode is rotatably mounted in a conventional manner adjacent a cathode 16 such that the beam of electrons 17 emanating from the cathode 16 is directed to impinge on the focal track 13 to generate X-rays.

The focal track 13 comprises a high-density ring 18 composed of a refractory metal, such as tungsten. The ring 18 can be applied to the substrate 12 by any of a number of methods, such as, by way of vapor deposition, brazing, plasma spraying, or mechanical connection. Brazing could be accomplished with the use of a suitable high-temperature braze material, such as zirconium or platinum. A mechanical attachment may be made similar to that shown in U.S. Pat. No. 3,795,832 mentioned above. The preferred method, however, is by way of chemical vapor deposition.

In order to accommodate the installation of the focal track 13, a circular groove 19 is formed in the substrate 12 as shown. A diffusion barrier 21 composed of a suitable material, such as rhenium, is then deposited in the groove 19 so as to prevent the high temperature diffusion of carbon from the substrate into the refractory ring 18 and thereby prevent carbide embrittlement of the focal track. The ring 18, composed of tungsten or a tungsten/rhenium alloy, is then chemical-vapor deposited to fill the groove 19 as shown.

A graphite substrate which has been found suitable for purposes of the present invention is Carbone Lorraine Grade 1116 PT Graphite which is commercially available from Carbone Lorraine Industries Corporation of Paris, France. This grade of graphite normally has a coefficient of thermal expansion which is slightly greater than that of tungsten (or tungsten rhenium) to thereby compensate for the thermal gradient across the interface. In this way the two materials can be joined so as to exhibit essentially no relative thermal differential expansion during tube operation.

Referring to FIG. 1, let us consider the consequences of radial misalignment between the focal track 13 and the cathode 16 as may occur in the normal course of fabrication. The preferred relationship is to have the smaller radial boundaries of the focal track 13 (as defined by the dimension r) centered within the larger radial boundaries of the electron beam as defined by the dimension R), as shown. The difference in the radial widths, as represented by the dimension $\Delta r$, then provides a range of overlapping electron beam which allows for a relative misalignment without affecting the location or size of the focal spot. For example, the electron beam 17 may move radially (i.e., left or right in FIG. 1), a distance of $\Delta r$, and the focal spot will remain in a fixed position with the dimension of D as shown. In contrast, it will be readily apparent that if the radial dimensions of the electron beam 17 and the focal track 13 were equal, such a misalignment would result in a focal spot with a dimension of less than the dimension D.

Figure 2:
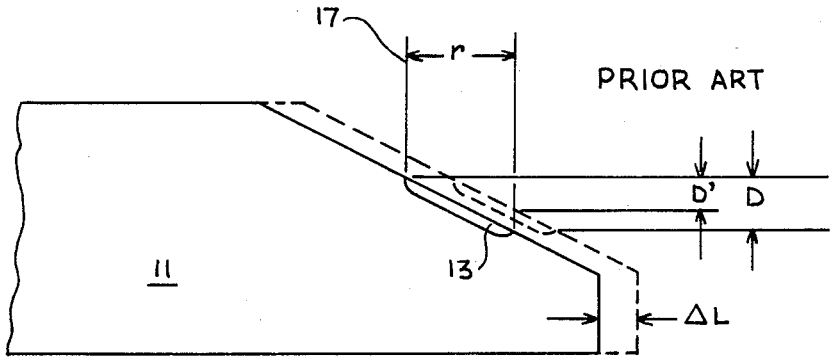
FIG. 2 is a schematic illustration of an X-ray tube target with a focal spot projected in accordance with the prior art.

Let us now consider the focal track as it may be affected by TIR. In FIG. 2 there is shown a prior art X-ray target arrangement wherein the radial width of the electron beam is equal to the radial width r of the focal track 13. As will be seen, when the two are perfectly aligned, the resultant focal spot is of a dimension D. Consider now what occurs when there is a TIR of $\Delta L$ as shown, with the position of the outer edge of the anode 11 and of the associated focal track 13 being indicated in dotted line. The useful part of the electron beam 17 is then reduced, and the size of the focal spot is accordingly reduced to a dimension D' as shown.

Figure 3:
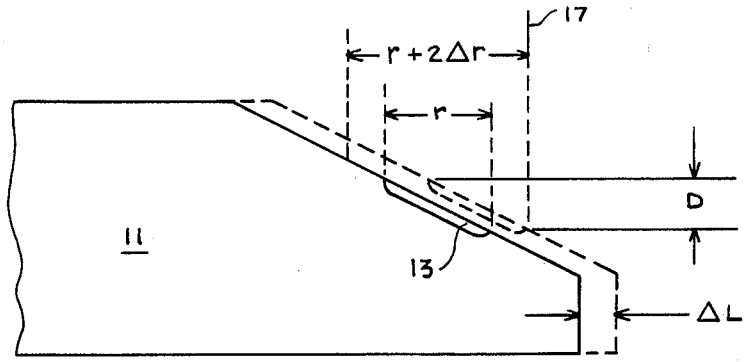
FIG. 3 is a schematic illustration of an X-ray tube target with a focal spot projected in accordance with the preferred embodiment of the invention.

Referring now to FIG. 3, there is shown a target arrangement in accordance with the present invention as having a focal track with the radial width of r and an electron beam with the radial width of $r+2\Delta r$. Again, let us assume that there exists a TIR of $\Delta L$ such that the focal track 13 is radially displaced to the position shown by the dotted lines. It will be seen that, because of the overlapping electron beam 17, the focal spot size will not be reduced but will remain in a fixed position with a width D as shown.

It is recognized that the overlapping of the electron beam 17 onto the graphite substrate 12 will cause some heating of the substrate and may require the substrate structure to be made somewhat larger in order to accommodate the heat-sink requirements. Accordingly, this overlap is preferably minimized by limiting it to that which is required for accommodating the total anticipated misalignment between the electron beam 17 and the focal track 13. This total misalignment is determined both by (1) the TIR that is inherently introduced with the installation of the anode 11 and (2) the displacement of the cathode 16 from its intended position with respect to the focal track 13 upon initial installation. If it is assumed that the second cause (i.e., that of cathode misplacement) can be eliminated, then one must still account for the TIR. Accordingly, the overlap ($\Delta r$) of the electron beam on each side of the focal track should be a minimum of 0.001 inches. In order to account for cathode displacement, the overlap should preferably be increased up to 0.125 inches, this upper limit being established to limit the heat which will be generated in the graphite by direct electron bombardment.

While the present invention has been disclosed with particular reference to a preferred embodiment, the concepts of this invention are readily adaptable to other embodiments. It will therefore be recognized that those skilled in the art may vary the structure thereof without departing from the essential spirit of the present invention.

What is claimed as new and desired to be secured by Letters Patent in the United States is:

1. An anode for a rotary X-ray tube of the type having a cathode for emitting a beam of electrons for bombardment of the focal track on the anode comprising:

a substrate having a circular face adapted to be disposed generally toward the cathode such that the electron beam is projected over a given radial dimension; and a circular focal track disposed on said substrate's circular face, said focal track being comprised of a refractory metal and having a radial dimension less than said given radial dimension.

2. An anode as set forth in claim 1 wherein said substrate is comprised of a graphite material.

3. An anode as set forth in claim 1 wherein said focal track is comprised of a tungsten material.

4. An anode as set forth in claim 1 and including a barrier layer between said substrate and said focal track, said barrier layer being comprised of a refractory material which is resistant to carbide formation.

5. An anode as set forth in claim 1 wherein said substrate has a coefficient of thermal expansion which is substantially equal to that of said focal track.

6. An anode as set forth in claim 1 wherein the difference in the radial dimension of said electron beam and that of said focal track is in the range of 0.002 to 0.250 inches.

7. An X-ray tube of the type having a rotating anode substrate with an associated annular focal track for receiving a beam of electrons from a cathode to produce X-rays, comprising:

an anode substrate composed of a relatively low-density material;

a focal track composed of a relatively high-density material attached to the substrate and having a predetermined radial dimension; and a cathode for producing a beam of electrons with a radial dimension slightly greater than said predetermined radial dimension of the focal track.

8. An X-ray tube as set forth in claim 7 wherein said anode substrate is comprised of a graphite material.

9. An X-ray tube as set forth in claim 1 wherein said focal track is comprised of a tungsten material.

10. An X-ray tube as set forth in claim 7 wherein the coefficient of thermal expansion of said substrate is substantially equal to that of said focal track.

11. An improved X-ray tube of the type of having a rotating anode substrate with an associated annual focal track for receiving a beam of electrons from the cathode to produce X-rays, the improvement comprising a focal track with a radial dimension which is slightly less than the radial dimension of the electron beam.

12. An X-ray tube as set forth in claim 11 wherein the difference in the radial dimension of the focal track and that of the electron beam is in the range of 0.002 to 0.250 inches.

13. An X-ray tube as set forth in claim 11 wherein said substrate is comprised of a graphite material.

14. An X-ray tube as set forth in claim 11 wherein said focal track is comprised of a tungsten material.

15. An X-ray tube as set forth in claim 11 wherein the coefficient of thermal expansion of the substrate is substantially equal to that of the focal track.

* * * * *